US008100499B2

(12) United States Patent
Mizes et al.

(10) Patent No.: US 8,100,499 B2
(45) Date of Patent: Jan. 24, 2012

(54) METHOD AND SYSTEM FOR DETECTING PRINT HEAD ROLL

(75) Inventors: Howard A. Mizes, Pittsford, NY (US); Steven Van Cleve Korol, Dundee, OR (US); Kenneth Ralph Chamberlain, Oregon City, OR (US)

(73) Assignee: Xerox Corporation, Norwalk, CT (US)

( * ) Notice: Subject to any disclaimer, the term of this patent is extended or adjusted under 35 U.S.C. 154(b) by 408 days.

(21) Appl. No.: 12/413,817

(22) Filed: Mar. 30, 2009

(65) Prior Publication Data

US 2010/0245455 A1 Sep. 30, 2010

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 6,213,580 | B1 | 4/2001 | Segerstrom et al. | |
| 7,837,290 | B2 * | 11/2010 | Mizes et al. | 347/19 |
| 2005/0179710 | A1 * | 8/2005 | Tatsuta et al. | 347/5 |
| 2006/0114283 | A1 | 6/2006 | Mizes et al. | |
| 2007/0024663 | A1 * | 2/2007 | Yamanobe | 347/19 |
| 2008/0062219 | A1 | 3/2008 | Mizes et al. | |

* cited by examiner

*Primary Examiner* — Julian Huffman
(74) *Attorney, Agent, or Firm* — Maginot, Moore & Beck, LLP

(57) ABSTRACT

A method of detecting print head roll begins with the formation of a test pattern on an image receiving surface. The test pattern includes a plurality of marks arrayed across the image receiving surface in a cross-process direction with each mark in the plurality being formed by a different nozzle of a print head. The cross-process direction positions of each mark in the plurality of marks are then detected; and the detected cross-process direction positions are correlated to a print head roll value for the print head.

8 Claims, 8 Drawing Sheets

METHOD AND SYSTEM FOR DETECTING PRINT HEAD ROLL

TECHNICAL FIELD

The present disclosure relates to imaging devices that utilize printheads to form images on media, and, in particular, to the alignment of such print heads in the imaging device.

BACKGROUND

Ink jet printing involves ejecting ink droplets from orifices in a print head onto a receiving substrate to form an image. Ink-jet printing systems commonly utilize either direct printing or offset printing architecture. In a typical direct printing system, ink is ejected from jets in the print head directly onto the final receiving substrate. In an offset printing system, the print head jets the ink onto an intermediate transfer surface, such as a liquid layer on a drum. The final receiving substrate is then brought into contact with the intermediate transfer surface and the ink image is transferred and fused or fixed to the substrate.

Alignment of the print head within an ink jet printing system including a single print head may be expressed as the position of the print head relative to the image receiving surface. Alignment of multiple print heads in ink jet printing systems including multiple print heads may be expressed as the position of one print head relative to the image receiving surface, such as a media substrate or intermediate transfer surface, or another print head within a coordinate system of multiple axes. For purposes of discussion, the terms "cross-process direction" and "X-axis direction" refer to a direction or axis perpendicular to the direction of travel of an image receiving surface past a print head, the terms "process direction" and "Y-axis direction" refer to a direction or axis parallel to the direction of an the image receiving surface, the term "Z-axis" refers to an axis perpendicular to the X-Y axis plane.

One particular type of alignment parameter is print head roll. As used herein, print head roll refers to clockwise or counterclockwise rotation of a print head about an axis normal to the image receiving surface, i.e., Z-axis. Print head roll misalignment may result from factors such as mechanical vibrations, and other sources of disturbances on the machine components, that may alter print head positions and/or angles with respect to an image receiving surface. As a result of roll misalignment, the rows of nozzles may be arranged diagonally with respect to the process direction movement of the image receiving surface as a result of the roll of the print head, which may cause horizontal lines, image edges, and the like to be skewed relative to the image receiving surface.

One method that may be used to detect print head roll is printing a horizontal line using one or more rows of nozzles of a print head and measuring the angle of the one or more lines with respect to the horizontal using a flatbed scanner or inline linear array sensor. The angle measurements may then be used to detect print head roll. Measuring angles of printed lines, however, requires precise alignment of the scanner or sensor with respect to the image receiving surface. If the measurement system uses a printed sheet on a flatbed scanner, rotation of the paper with respect to the scanner may produce inaccurate measurements. Similarly, if the measurement system utilizes an inline linear array sensor, misalignment of the sensor with respect to the image receiving surface may produce inaccurate measurements.

SUMMARY

A method of detecting print head roll has been developed that is insensitive to misalignment or skew of an image sensor relative an image receiving surface or of misalignment of the image receiving surface relative to the image sensor. In particular, the method of detecting print head roll begins with the formation of a test pattern on an image receiving surface. The test pattern includes a plurality of marks arrayed across the image receiving surface in a cross-process direction with each mark in the plurality being formed by a different nozzle of a print head. The cross-process direction positions of each mark in the plurality of marks are then detected; and the detected cross-process direction positions are correlated to a print head roll value for the print head.

In another embodiment, a method of detecting print head roll includes the formation of a test pattern on an image receiving surface. The test pattern includes a plurality of marks arrayed across the image receiving surface in a cross-process direction with each mark in the plurality being formed by a different nozzle of a print head. The test pattern is then scanned to determine cross-process direction spacings between each mark in the plurality of marks. The determined cross-process direction spacings are then correlated to a print head roll value for the print head.

In another embodiment, a system for detecting print head roll is provided. The system includes a test pattern comprising a plurality of marks arrayed across an image receiving surface in a cross-process direction, each mark in the plurality being formed by a different nozzle of a print head. The system includes an image sensor configured to generate signals indicative of a cross-process direction position of each mark in the test pattern. A controller is configured to receive the signals from the image sensor and to correlate the cross-process direction positions of the marks to a print head roll value for the print head.

DETAILED DESCRIPTION

Figure 1:
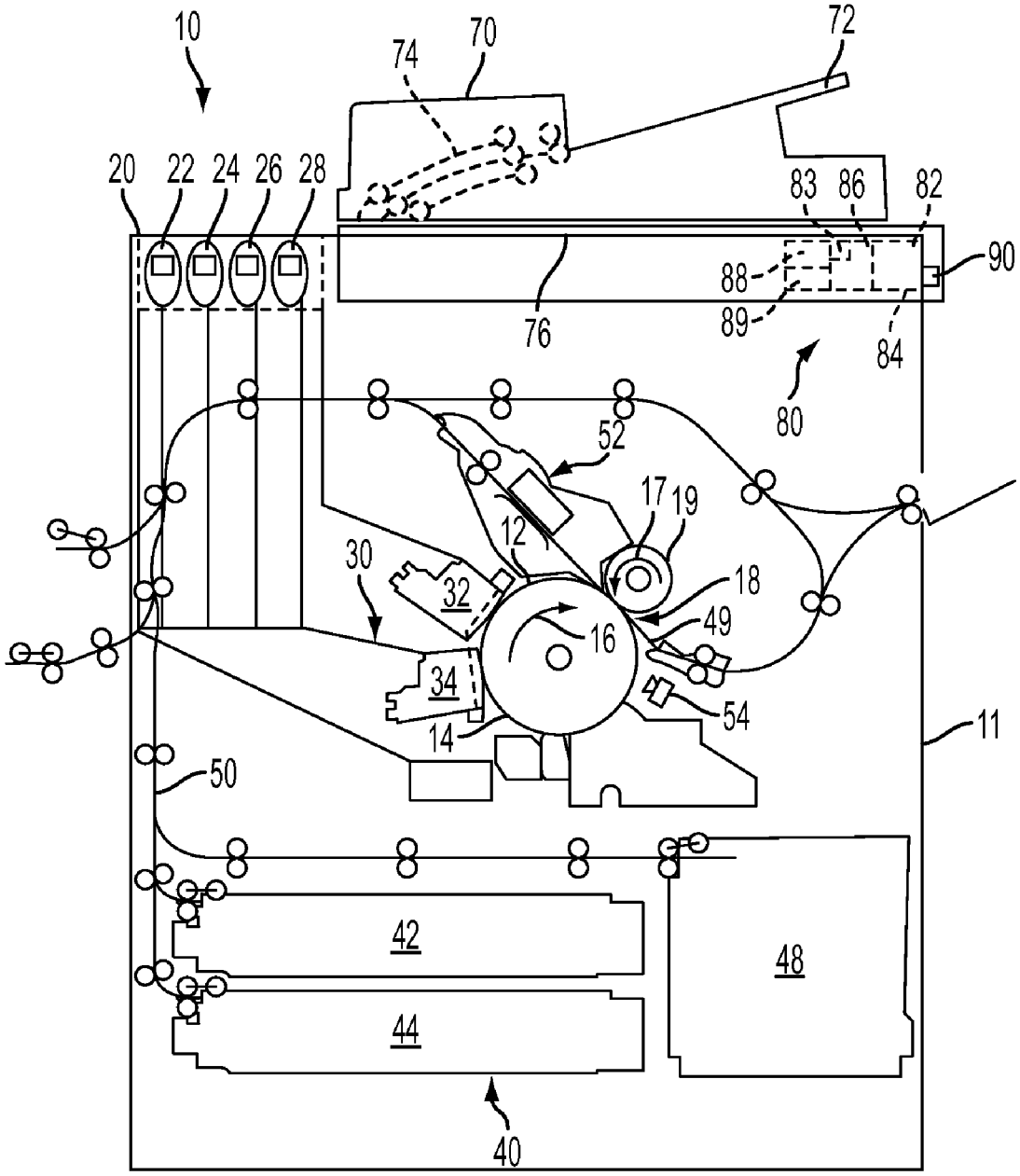
FIG. 1 is a schematic elevational view of an embodiment of an imaging device.

For a general understanding of the present embodiments, reference is made to the drawings. In the drawings, like reference numerals have been used throughout to designate like elements.

Aspects of the exemplary embodiment relate to an imaging device and to a registration system for an imaging device. The imaging device includes an extensible image receiving member, such as a web or drum, which defines an image receiving surface that is driven in a process direction between marking stations. As used herein, the process direction is the direction in which the substrate onto which the image is transferred moves through the imaging device. The cross-process direction, along the same plane as the substrate, is substantially perpendicular to the process direction.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Referring now to FIG. 1, an embodiment of an imaging device 10 of the present disclosure, is depicted. As illustrated, the device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A heated transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media.

The imaging device 10 also includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

The ink delivery system is configured to supply ink in liquid form to a print head system 30 including at least one print head assembly 32. Since the imaging device 10 is a high-speed, or high throughput, multicolor device, the print head system 30 includes multicolor ink print head assemblies and a plural number (e.g. four (4)) of separate print head assemblies (32, 34 shown in FIG. 1).

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the print head assemblies 32, 34, 36, 38. As such, the ESS or controller 80 is the main multi-tasking processor for operating and controlling all of the other machine subsystems and functions, including the print head cleaning apparatus and method discussed below.

In operation, image data for an image to be produced are sent to the controller 80 from either the scanning system 76 or via the online or work station connection 90 for processing and output to the print head assemblies 32, 34, 36, 38. Additionally, the controller determines and/or accepts related subsystem and component controls, for example, from operator inputs via the user interface 86, and accordingly executes such controls. As a result, appropriate color solid forms of phase change ink are melted and delivered to the print head assemblies. Additionally, pixel placement control is exercised relative to the imaging surface 14 thus forming desired images per such image data, and receiving substrates are supplied by any one of the sources 42, 44, 48 along supply path 50 in timed registration with image formation on the surface 14. Finally, the image is transferred from the surface 14 and fixedly fused to the copy sheet within the transfix nip 18.

The imaging device may include an inline image sensor 54. The inline image sensor is configured to detect, for example, the presence, intensity, and/or location of ink drops jetted onto the receiving member by the inkjets of the print head assembly. In one embodiment, the image sensor includes a light source (not shown) and a light sensor (not shown). The light source may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source are coupled to the controller 80, which selectively activates the LEDs. The controller 80 may generate signals indicating which LED or LEDs to activate in the light source.

The reflected light is measured by the light sensor. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

The controller is configured to provide control signals to the image sensor 54 that, for example, selectively activate the LEDS to direct light onto the web and/or activate the light sensors to detect reflected light from the image receiving surface. The activation of the light sources and light sensors of the image sensor may be synchronized to the movement of the image receiving surface so that the surface is scanned only in targeted areas where images from one or more of the print heads are formed.

Figure 2:
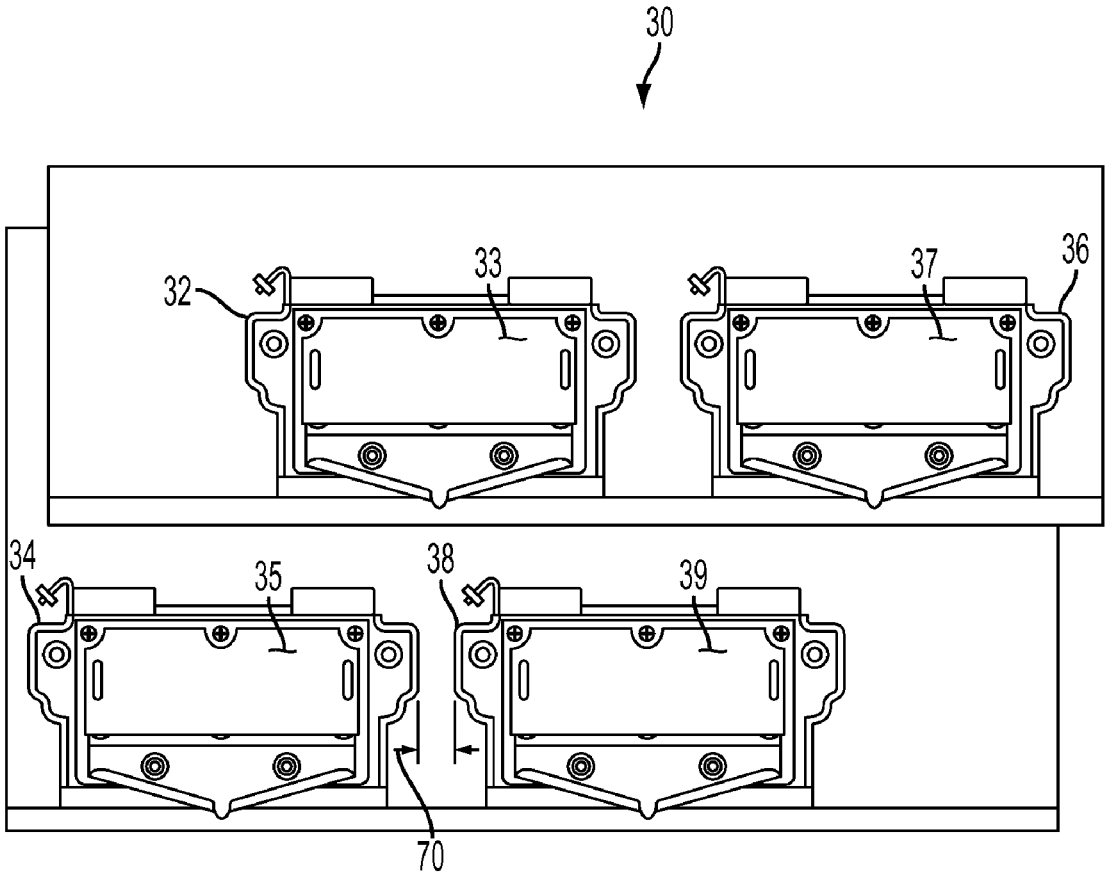
FIG. 2 is a perspective view of the arrangement of print heads in the imaging device of FIG. 1.

Referring now to FIG. 2, the printer/copier 10 described in this example is a high-speed, or high throughput, multicolor image producing machine, having four print heads, including upper print heads 32 and 36, and lower print heads 34 and 38. Each print head 32, 34, 36 and 38 has a corresponding front face, or ejecting face, 33, 35, 37 and 39 for ejecting ink onto the receiving surface 14 to form an image. While forming an image, a mode referred to herein as print mode, the upper print heads 32, 36 may be staggered with respect to the lower print heads 34, 38 in a direction transverse to the receiving surface path 16 (FIG. 1) in order to cover different portions of the receiving surface 14. The staggered arrangement enables the print heads to form an image across the full width of the substrate.

The ejecting face of each print head includes a plurality of nozzles that are arranged in rows and columns in the ejecting face at positions that correspond to ink jet positions in the print head. Nozzle rows extend linearly in the cross-process direction of the ejecting face. Nozzles may also be arranged linearly in the process direction of the ejecting face. The spacing between each nozzle in a row, however, is limited by the number of ink jets that can be placed in a given area in the print head. In order to increase the printing resolution, the nozzles in the rows may be offset or staggered from the nozzles in at least some of the other rows extending in the cross-process direction (along the X axis). Staggering or offsetting the nozzles in the rows increases the number of columns of ink that may be formed per unit of distance in the cross-process direction of an image receiving surface, and thus increases the resolution of images that may be formed by the imaging device.

Figure 3:
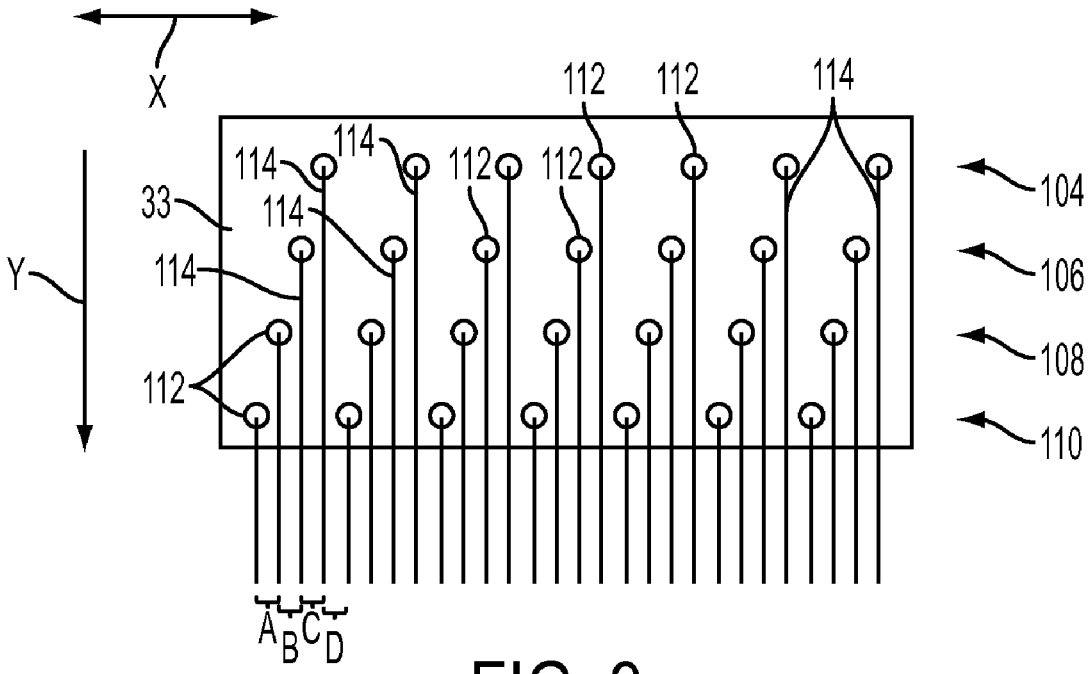
FIG. 3 is a simplified front view of an ejecting face of a print head.

A simplified illustration of an ejecting face, such as ejecting face 33 of print head 32, is depicted in FIG. 3 having four rows of nozzles 104, 106, 108, 110 with each row having seven nozzles 112. The staggered arrangement of the rows 104, 106, 108, 110 provides the print head with twenty-eight nozzles. Print heads may be provided with more or fewer rows and each row may be provided with more or fewer nozzles than are depicted in FIG. 3. Each print head may be configured to emit ink drops of each color utilized in the imaging device. Thus, each print head may include one or more rows of nozzles for each color of ink used in the imaging device. In another embodiment, each print head may be configured to utilize one color of ink and thus may have a plurality of rows of nozzles that are each configured to eject the same color of ink.

As mentioned above, one factor that affects imaging operations is alignment of a print head with respect to the receiving substrate and with respect to other print heads in the imaging device. One particular type of alignment parameter is print head roll. As used herein, print head roll refers to clockwise or counterclockwise rotation of a print head about an axis normal to the image receiving surface. Print head roll may result from factors such as mechanical vibrations, head mounting, periodic head maintenance, and other sources of disturbances on the machine components, that may alter print head positions and/or angles with respect to an image receiving surface.

Figure 4:
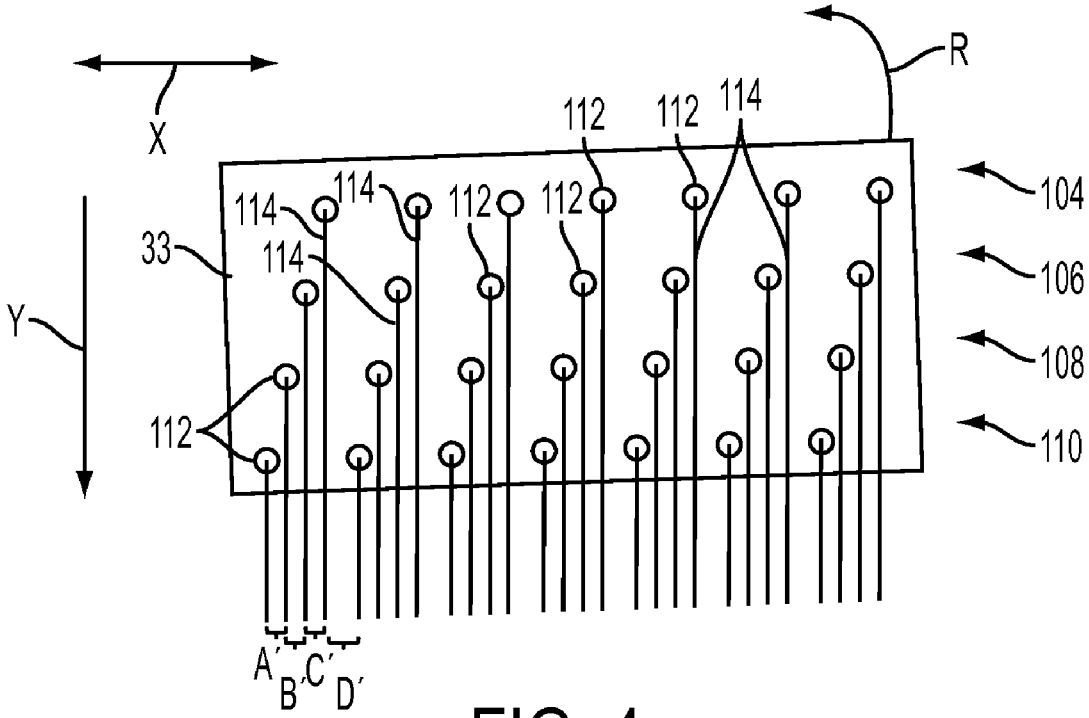
FIG. 4 is a front view of the ejecting face of FIG. 3 exhibiting print head roll.

FIG. 4 depicts the simplified ejecting face of FIG. 3 exhibiting a counterclockwise roll misalignment R. As a result of counterclockwise roll misalignment, the rows of nozzles 104, 106, 108, 110 of the print head in FIG. 4 are not perpendicular with respect to the process direction Y movement of the image receiving surface, which may cause printed lines, image edges, and the like to be skewed relative to the image receiving surface. While print head roll may be detected by measuring the angles of printed lines, image edges, and the like, using a flatbed scanner or inline sensor array and correlating the measured angles to print head roll, the measurement of angles of printed lines may be susceptible to inaccuracies. For example, if the measurement system uses a printed sheet on a flatbed scanner, rotation of the paper with respect to the scanner may produce inaccurate measurements. Similarly, if the measurement system utilizes an inline linear array sensor, misalignment of the sensor with respect to the image receiving surface may produce inaccurate measurements.

Another consequence of print head roll misalignment is a change in the spacing between jets in the cross-process direction (X axis) of the ejecting face. Depending on the arrangement of nozzles in the ejecting face and the direction or roll (e.g., clockwise or counterclockwise), X axis spacing between nozzles may be increased or decreased, and in some cases, may result in unequal spacing, or gaps, in coverage along the X axis of the ejecting face. For example, as depicted in FIG. 4, the spacings, such as A', B', C', and D', between nozzles from different rows is changed due to the roll of the print head relative to the spacings A, B, C, D between the same nozzles in FIG. 3. In addition, as the progression of nozzles along the x axis transitions from the top row 104 to the bottom row 110, gaps D' are formed that are larger than the spacing, A', B', C', between the other nozzles. If the roll of the print head was in the opposite direction from that depicted in FIG. 4, i.e., clockwise direction, the opposite would be true. For example, with the embodiment of the ejecting face of FIG. 3 having a clockwise roll misalignment, the spacings A', B', C', between nozzles as the nozzles progress from the bottom row 110 to the top row 104 would be greater than the spacing between the nozzles at the transitions D' from the top 104 to the bottom row 110. In either case, such gaps and unequal spacing may result in periodic high frequency banding in images formed by the print head.

Print head roll may be detected by measuring or detecting the difference in cross-process direction (X axis) spacing between marks, such as dashes, dots, and the like, formed using at least two different nozzles of a print head from an expected spacing between the marks. For example, referring to FIGS. 3 and 4, print head roll may be detected by measuring the distances between marks formed by the nozzles. The distance between marks corresponds to the distance between nozzles. The distances, such as, A', B', C', D' may be compared to, for example, an expected spacing between the marks/nozzles. In the embodiment of FIGS. 3 and 4, expected spacings A, B, C, D between marks/nozzles correspond to the distances or spacings between marks when the print head is positioned optimally, i.e., with little to no print head roll. Expected distances or spacings between marks for a given test pattern are known and may be determined empirically during manufacture and testing of an imaging device with the print head(s) of the imaging device positioned within head roll tolerances with respect to the image receiving surface. The difference between detected spacings, e.g., A', B', C', D' of FIG. 4, between marks and expected spacings, e.g., A, B, C, D of FIG. 3, between marks in the cross-process direction X is proportional to the roll of the print head. In addition, the detection of cross-process spacing between marks formed by different nozzles of a print head is insensitive to misalignment of a printed sheet with a flatbed scanner or to skew of an inline linear array sensor with respect to the image receiving surface.

In one embodiment, in order to detect print head roll, the controller is configured to actuate at least one print head of the imaging device to form a test pattern onto the image receiving surface. A test pattern comprises a plurality of marks formed on an image receiving surface that are spaced from each other extending in the cross-process direction (X axis) of the image receiving surface. Each mark in a test pattern is formed using a different nozzle of a print head. Any suitable number of nozzles and positioning of nozzles in the ejecting face of a print head may be utilized to form a test pattern. For example, test patterns may be printed using as few as two nozzles or all of the nozzles of a print head. The marks in a test pattern may be any suitable type of mark, such as dashes, dots, or the like, that enable detection of the cross-process direction distances between the marks.

Test patterns comprise data, such as, for example, a bitmap, for the controller indicating from which ink jets/nozzles to eject drops and timings for the actuations. Test patterns may be created and stored in the memory during system design or manufacture. Alternatively, the controller may include software, hardware and/or firmware that are configured to generate test patterns "on the fly." The controller is operable to generate drop ejecting signals for driving the ink jets to eject drops through the corresponding nozzles in accordance with the test patterns.

Figure 5:
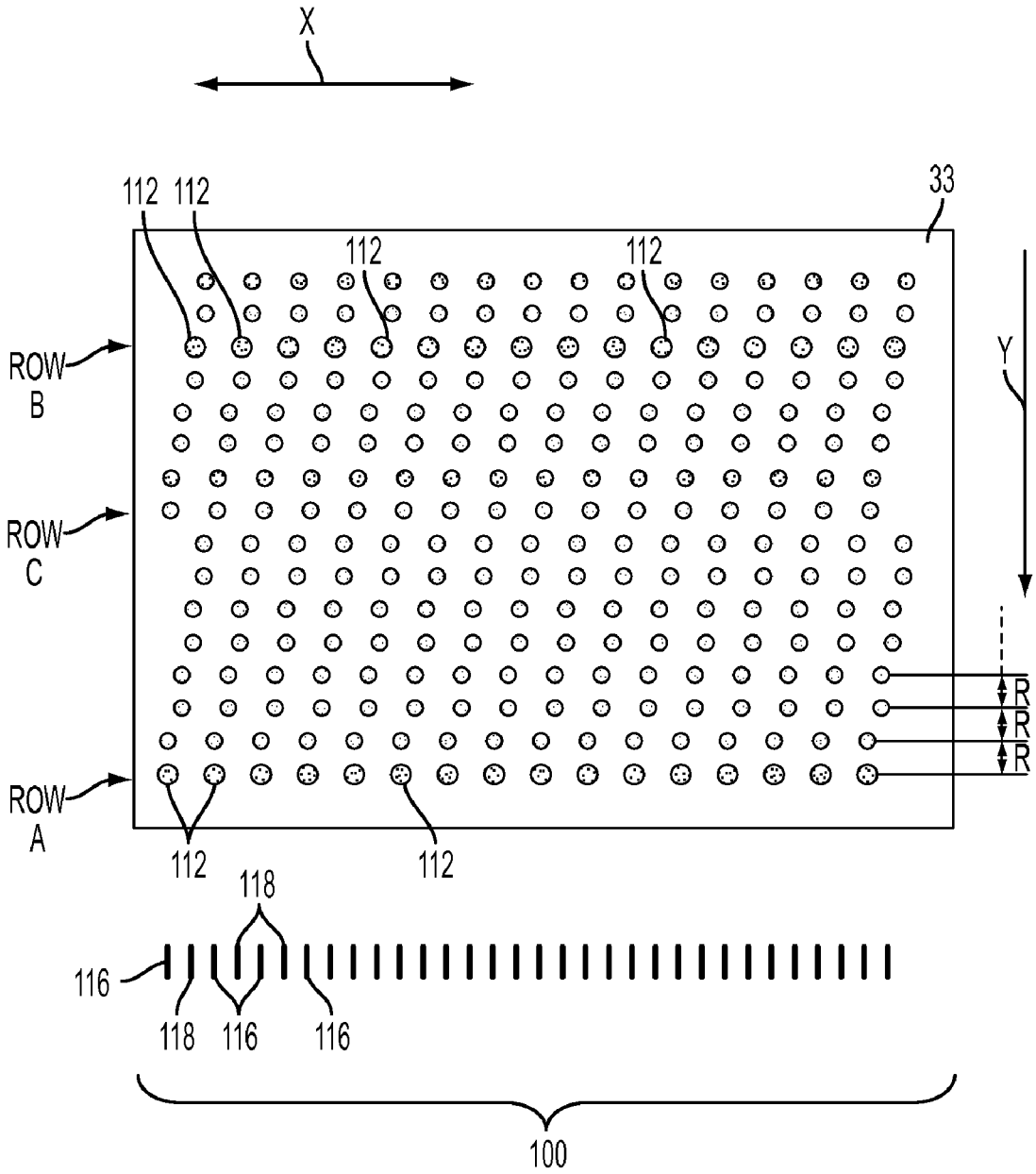
FIG. 5 depicts an embodiment of a test pattern that may be used to detect print head roll and the print head used to form the test pattern.

A test pattern may be printed using nozzles from at least two different rows of nozzles in the print head. FIG. 5 shows an embodiment of a test pattern 100 printed using each nozzle 112 from two rows, e.g., row A and row B. The resulting test pattern 100 is comprised of an array of marks 116, 118 that extends in the cross-process direction X that alternates between a mark 116 printed by a nozzle from row A ("row A mark") and a mark 118 formed by a nozzle from row B ("row B mark"). Although any two rows may be used to form the test pattern, the rows selected to form a test pattern may be chosen to enhance the ability to detect differences in detected spacings between marks from expected spacings between the marks. For example, rows selected to form a test pattern are advantageously spaced from each other in the process direction Y of the ejecting face 33 of a print head so that small rotations of the print head cause a relatively large change in the spacings between marks. In addition, rows of nozzles may be selected to form a test pattern based on the expected cross-process direction spacings between the marks formed by nozzles from the different rows. For example, rows may be selected so that the expected spacing between each mark 116, 118 in the pattern is substantially the same as depicted in FIG. 5. In the test pattern of FIG. 5, rows A and B were selected because the expected spacing between each pair of marks with a row A mark on the left and a row B mark on the right (116-118) is substantially the same as the expected spacing between each pair of marks with a row B mark on the left and a row A mark on the right (118-116).

One issue faced in the measurement of the distances between marks of a test pattern is drop misdirection resulting in position deviations of marks from intended positions. Drop misdirection is uncorrelated from jet to jet and may occur, for instance, due to fabrication non-uniformity from nozzle to nozzle or due to dirt, debris, deposits, or the like in or around a nozzle. In the embodiment of FIG. 5, drop misdirection may be accounted for by averaging the measured distances between corresponding mark pairs, e.g., (116-118), (118-116). For example, the measured spacings between corresponding nozzle pairs, e.g., row A nozzle on left with row B nozzle on right, or row B nozzle on left with row A nozzle on right, may be averaged across the test pattern. If the spacings for corresponding nozzle pairs are averaged across the test pattern, the cumulative cross-process direction drop misdirection error tends toward zero, effectively canceling itself out.

With knowledge of the measured spacings and/or average measured spacings, and the expected spacings between the marks of the pattern, a determination may be made by the controller as to whether the print head is exhibiting roll as well as the degree or magnitude of the roll. Print head roll may be determined based on the test pattern of FIG. 5 in a number of ways. For example, in the embodiment of FIG. 5, the process direction distance between each row is h. Row A is the first row and row B is the fourteenth row of the print head so the process direction distance between row A and row B is 13 h. In one embodiment, the process direction distance between rows is approximately 786 μm so the distance between row A and row B is approximately 10,218 μm. If the print head is rolled at an angle $\phi$ and the distance between rows is much greater than the difference between nearest neighbor marks 116 and 118, the cross-process direction spacings between marks formed by the nozzles are either increased or decreased by approximately $10{,}218*\sin(\phi)$. If the average measured spacing between mark pairs with a row A mark 116 on the left and a row B mark 118 on the right is designated by $x_{mk}$, and the average measured spacing between mark pairs with a row B mark 118 on the left and a row A mark on the right 116 is designated by $x_{km}$, then the head roll ($\phi$) for the print head is given by $\phi=(x_{km}-x_{mk})/(2*10,218)$.

Figure 6:
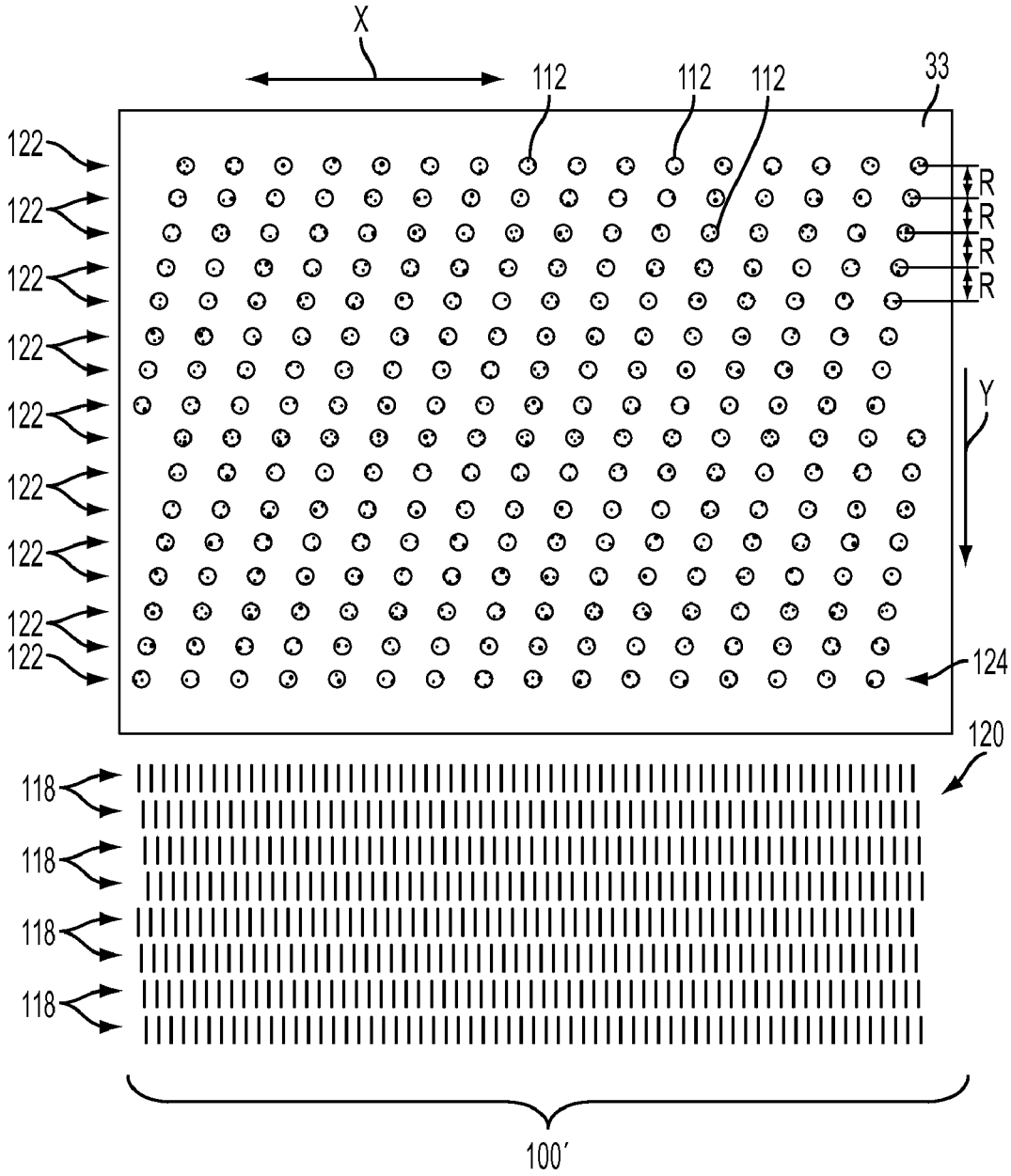
FIG. 6 depicts another embodiment of a test pattern that may be used to detect print head roll and the print head used to form the test pattern.

FIG. 6 shows another embodiment of a test pattern 100' that may be utilized to detect and measure print head roll. The test pattern of FIG. 6 was printed using each nozzle from a plurality of different rows of nozzles in the print head. The resulting test pattern 100' is comprised of a plurality of rows 118 of marks 120 extending in the cross-process direction X with each row 118 of marks corresponding to a subset of nozzles from the print head 33. The test pattern 100' may be scanned to determine the cross-process direction X distance between each mark 120 from each row 118 in the pattern and the corresponding mark from a reference row 124 in the pattern to the left (i.e., in the cross-process direction) of each mark. In the embodiment of FIG. 6, the reference row 124 of nozzles is the first row (bottom row in FIG. 6) of nozzles although any of the rows of nozzles may be designated as the reference row of nozzles.

Figure 7:
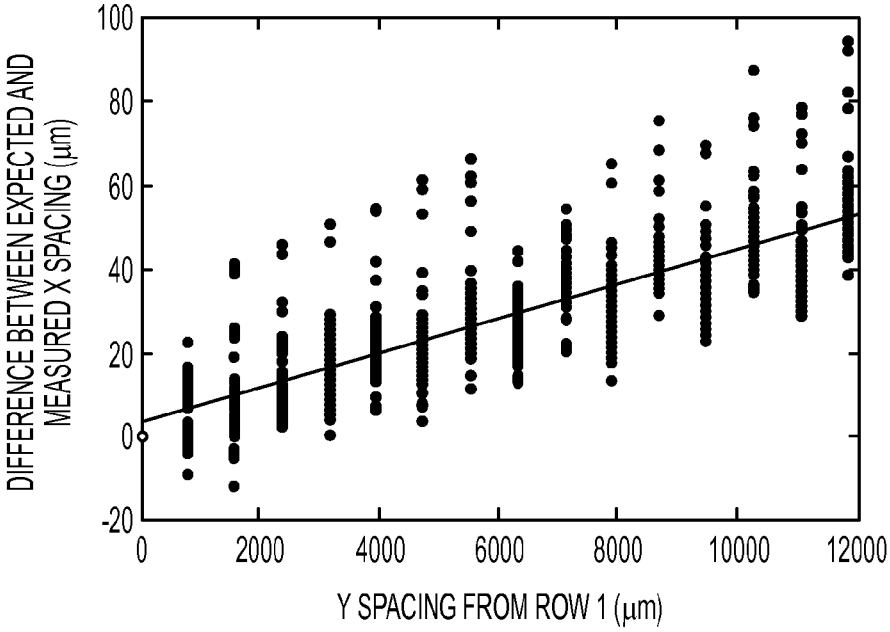
FIG. 7 is a graph of the differences in expected and measured spacing between marks of the test pattern of FIG. 6 versus process direction distance of the marks relative to row 1.

Similar to the discussion above in regards to FIG. 5, the process direction distance Y between each row in FIG. 6 may be designated as h so the process direction distance between row 124 and a row J, for example, is (J−1)n. In one embodiment, the process direction distance Y between rows is approximately 786 μm so the distance between row 124 and row J is approximately 786*(J−1)μm. If the print head is rolled at an angle ϕ, the cross-process direction spacings between marks formed by the nozzles are either increased or decreased by 786*(J−1)*sin(ϕ). FIG. 7 is a graph that plots the difference between the expected spacing and measured spacing between marks of the pattern versus the process direction difference (Y axis) in spacing from row 1 of the print head. The plot can be fitted with a straight line using known techniques such as, for example, a least squares approximation. As depicted in FIG. 7, the slope of the straight line is substantially proportional to the roll of the print head. As expected, the differences between measured spacings and expected spacings increases as the distance process direction distance from row 1 increases.

Another factor that influences the measurement of print head roll is lateral motion of a print head relative to an image receiving surface. In the imaging device of FIG. 1, for example, the print heads may be configured for translation a predetermined distance (Δp) in the cross-process direction relative to the drum. The angle of process direction lines is approximately θ=Δp/C, where C is the circumference of the drum. The roll of the head should be set to this value and will be if ϕ is set to zero.

For an imaging device configured to form images on a continuous web of media, a factor that may influence measurement of print head roll is lateral motion of web of media with respect to the print heads. Using the test pattern of FIG. 6, the print head roll and the lateral motion of the web may be determined simultaneously. If there is lateral motion of the web, the marks will be shifted as a function of nozzle row. The angle of the lateral motion of the web is given by the ratio of the lateral shift of the web over a distance from the first row of nozzles to the last row of nozzles to the distance from the first row of nozzles to the last row of nozzles. The angle of lateral motion of the media web may be subtracted from the head roll measurement described above to enable a more accurate measurement of the head roll.

Figure 8:
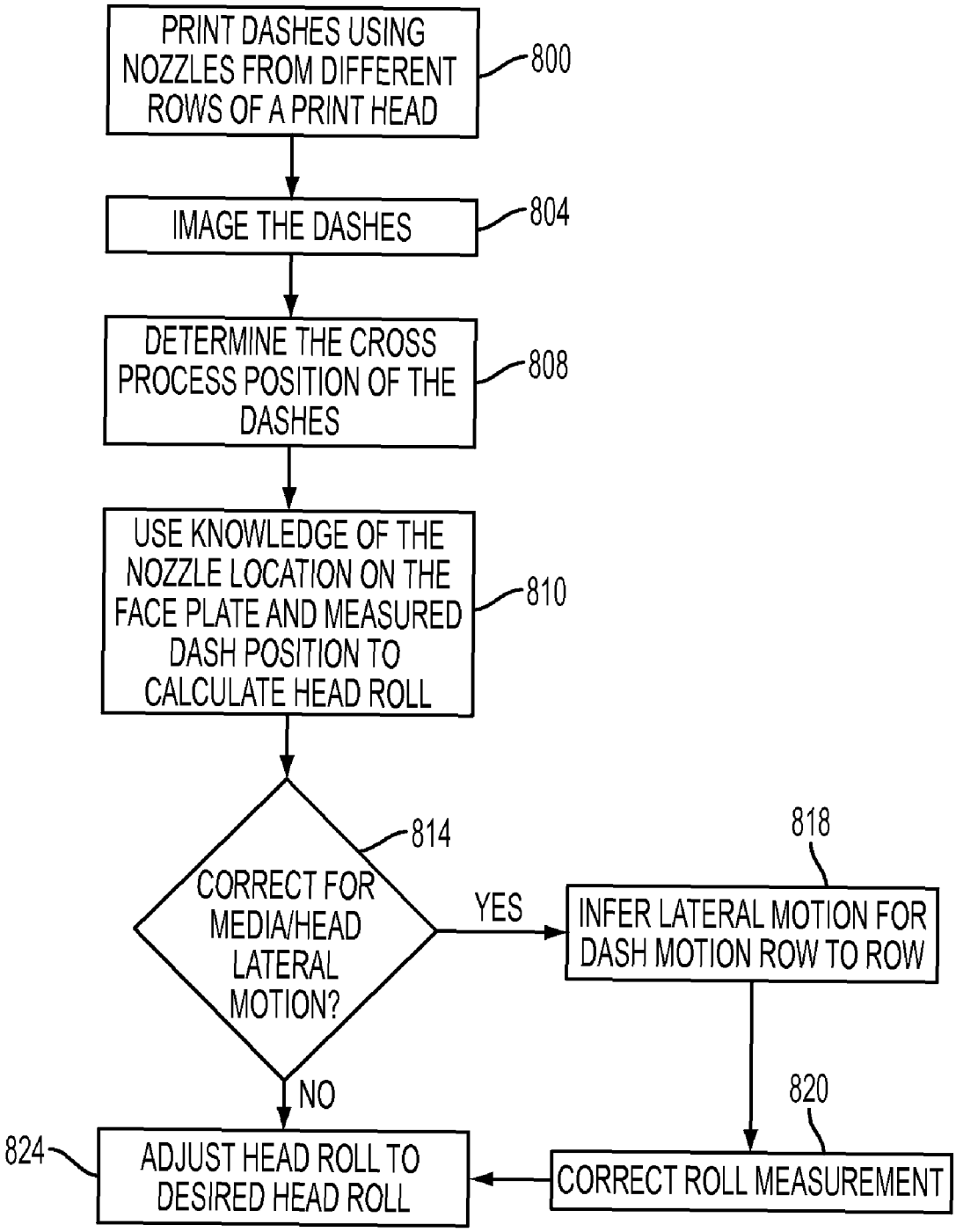
FIG. 8 is a flowchart of a method of detecting print head roll.

A flowchart of an embodiment of a method for detecting and measuring roll of a print head is shown in FIG. 8. The method begins with the formation of a test pattern onto an image receiving surface. The image receiving surface may be an intermediate transfer surface, such as a drum or belt, or may be a sheet or continuous web of media. The test pattern is an array of marks extending in the cross-process direction of the image receiving surface that formed by a plurality of nozzles from at least two different rows of nozzles of a print head (block 800). After the test pattern has been printed onto the image receiving surface, the test pattern is imaged using an image sensor (block 804) to detect the cross-process direction positions of the marks (block 808). For example, once a test pattern has been formed on the image receiving surface, the test pattern may be scanned inline in the imaging device by an inline linear array sensor. Alternatively, test patterns may be printed onto a sacrificial media sheet and scanned using, for example, a flatbed scanner. In either case, sensor signals are output to the controller that are indicative of the cross-process direction positions of the marks in the test pattern.

A print head roll value for the print head is then determined based on the detected cross-process direction positions of the marks in the pattern (block 810). The print head roll value may be determined from the detected cross-process direction positions of the marks in any suitable manner in the manner described above. At block 814, a decision is made as to whether or not the determined print head roll value should be adjusted or corrected for lateral motion such as print head lateral motion relative to the media or media lateral motion relative to the print head. If no further adjustments of the print head roll are deemed to be necessary, control passes to block 824 at which point the physical position of the print head in the imaging device is adjusted to change the roll from its measured value to its desired value. If further adjustment is required, then the relative motion between the media and the print head may be calculated using the slope of the graph that plots expected average mark position in the cross-process direction versus the process direction position of the row of the nozzle used to form the marks. Lateral motion may be inferred for row to row changes in mark position (block 818). The determined print head roll may then be corrected for media/head lateral motion (block 820). Control then passes to block 824 at which point the physical position of the print head in the imaging device is adjusted to change the roll from its measured value to its desired value. Adjusting the physical positions of print heads within an imaging device to correct roll is known in the art. Therefore, the exact method of adjusting the physical position of the print head to correct print head roll is not critical to this disclosure.

Figure 9A:
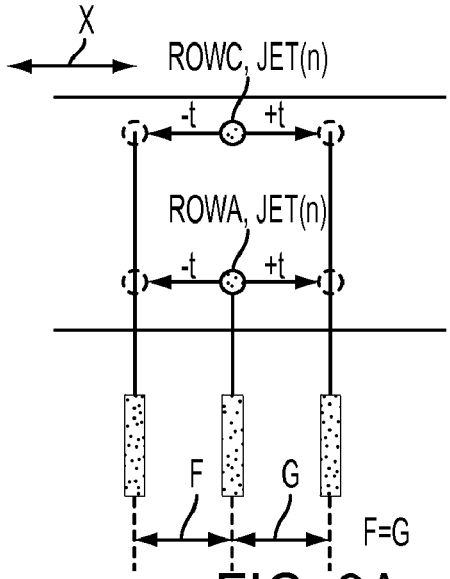
FIGS. 9*a* and 9*b* depict an alternative embodiment of a test pattern for print head roll measurement that utilizes a jet interlacing technique.
Figure 9B:
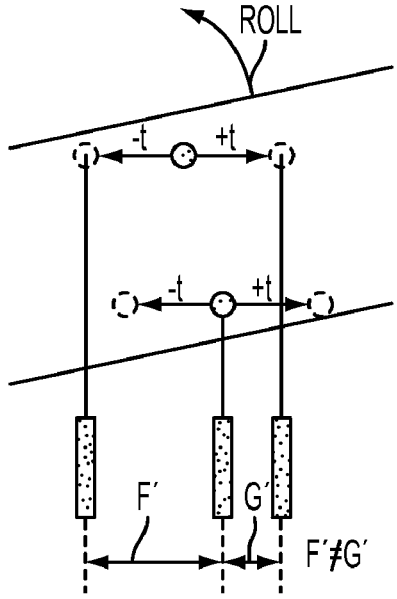

FIGS. 9*a* and 9*b* show an alternative embodiment of a test pattern for measuring print head roll that uses a jet interlacing technique. As used herein, the term "jet interlacing" refers to printing marks from jets that are in the same X axis position in a print head, such as the left most jet (1) from row A and the left most jet (1) from row C of FIG. 5, such that the marks are spaced from each other in the X axis. Interlacing may be used to increase the resolution (DPI) of a printer by printing dots closer together in the X axis than the X axis spacing between jets. As depicted in FIG. 9*a*, an interlace test pattern may be printed by printing marks from one or more jets (n) from a first row of jets of the printhead, e.g., row A (FIG. 5), translating the printhead an interlace distance +t along the X axis in a first direction and printing marks using one or more jets(n) from another row that is aligned with the jets(n) from row A, e.g. row C (FIG. 5) where n corresponds to the number or position of jets in a row. The printhead is then translated in the opposite direction an interlace distance −t along the x axis and the one or more jets from row C are actuated to print marks on the opposite side marks printed by jet(n) from row A. When the print head is not rolled, the spacings F and G are substantially the same. However, when the print head exhibits a roll such as the counterclockwise roll depicted in FIG. 9*b*, the spacings F' and G' between the marks are changed relative to the spacings F and G between the same marks in FIG. 9*a*.

Using the print head configuration described above in relation to FIG. 5, if the print head is rolled at an angle ϕ, the cross-process direction spacings F and G between marks formed by the jets are either increased or decreased by approximately 10,218*sin(ϕ). If the average measured spacing F between mark pairs with a jet(n), row C mark on the left and a jet(n) row A mark 118 on the right is designated by $F_{avg}$, and the average measured spacing G between mark pairs with a jet(n), row A mark on the left and a jet(n), row C mark on the right 116 is designated by $G_{avg}$., then the head roll (ϕ) for the print head may be given by $\phi=(F_{avg}-G_{avg})/(2*10,218)$.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of detecting print head roll in an ink jet printing system including one or more print heads, the method comprising:

forming a test pattern on an image receiving surface using each nozzle from two different rows of nozzles of one print head, the test pattern comprising a plurality of marks arrayed across the image receiving surface in a cross-process direction, each mark in the plurality being formed by a different nozzle of the one print head;

detecting the cross-process direction positions of each mark in the plurality of marks;

determining cross-process direction spacings between marks in the test pattern based on the detected cross-process direction positions;

determining differences between the determined cross-process direction spacings and expected cross-process direction spacings for the marks in the test pattern;

correlating the determined differences between the cross-process direction spacings and the expected spacings to a print head roll value for the print head;

modifying the print head roll value based on lateral motion of the image receiving surface prior to adjusting the physical position of the print head; and adjusting a physical position of the print head based on the modified print head roll value.

2. The method of claim 1, the detection of cross-process direction positions further comprising:

scanning the test pattern using an inline linear array sensor; and generating signals indicative of the cross-process direction positions of the marks of the test pattern.

3. The method of claim 1, the detection of cross-process direction positions further comprising:

scanning the test pattern using a flatbed scanner; and generating signals indicative of the cross-process direction positions of the marks of the test pattern.

4. A method of detecting print head roll in an ink jet printing system including one or more print heads, the method comprising:

forming a test pattern on an image receiving surface using each nozzle from two different rows of nozzles of one print head, the test pattern comprising a plurality of marks arrayed across the image receiving surface in a cross-process direction, each mark in the plurality being formed by a different nozzle of the one print head;

scanning the test pattern to determine a cross-process direction spacing between each mark in the plurality of marks;

determining differences between the determined cross-process direction spacings and expected cross-process direction spacings for the marks in the test pattern;

correlating the determined differences between the cross-process direction spacings and the expected spacings to a print head roll value for the print head;

modifying the print head roll value based on lateral motion of image receiving surface prior to adjusting the physical position of the print head; and adjusting a physical position of the print head based on the modified print head roll value.

5. The method of claim 4, the detection of cross-process direction positions further comprising:

scanning the test pattern using an inline linear array sensor; and generating signals indicative of the cross-process direction positions of the marks of the test pattern.

6. The method of claim 4, the detection of cross-process direction positions further comprising:

scanning the test pattern using a flatbed scanner; and generating signals indicative of the cross-process direction positions of the marks of the test pattern.

7. A system for detecting print head roll in an ink jet printing system including one or more print heads, the system comprising:

a print head configured to form the test pattern on an image receiving surface, the test pattern comprising a plurality of marks arrayed across an image receiving surface in a cross-process direction, each mark in the plurality being formed by a different nozzle of one print head with nozzles from at least two different rows in the one print head;

an image sensor configured to generate signals indicative of a cross-process direction position of each mark in the test pattern; and a controller configured to receive the signals from the image sensor and to determine a cross-process direction spacing between each mark in the plurality of marks from the signals indicative of the cross-process direction positions of the marks received from the image sensor, to determine differences between the determined cross-process direction spacings and expected cross-process direction spacings for the marks in the test pattern, to correlate the determined differences between the cross-process direction spacings and the expected spacings to a print head roll value for the print head, to modify the print head roll value based on lateral motion of image receiving surface for physical adjustment of the print head with reference to the modified print head roll value.

8. The system of claim 7, the image sensor comprising an inline linear array sensor.

* * * * *